US011655786B2

(12) United States Patent
Hornby

(10) Patent No.: US 11,655,786 B2
(45) Date of Patent: May 23, 2023

(54) FUEL INJECTOR

(71) Applicant: Stanadyne LLC, Jacksonville, NC (US)

(72) Inventor: Michael Hornby, Emerald Isle, NC (US)

(73) Assignee: Stanadyne LLC, Jacksonville, NC (US)

( * ) Notice: Subject to any disclaimer, the term of this patent is extended or adjusted under 35 U.S.C. 154(b) by 0 days.

(21) Appl. No.: 17/825,806

(22) Filed: May 26, 2022

(65) Prior Publication Data

US 2022/0381212 A1 Dec. 1, 2022

Related U.S. Application Data

(60) Provisional application No. 63/194,568, filed on May 28, 2021.

(51) Int. Cl.

| | |
|---|---|
| ***F02M 51/06*** | (2006.01) |
| ***F02M 21/02*** | (2006.01) |
| ***F02M 61/20*** | (2006.01) |

(52) U.S. Cl.

CPC .... *F02M 51/0667* (2013.01); *F02M 21/0263* (2013.01); *F02M 61/20* (2013.01); *F02M 2200/50* (2013.01)

(58) Field of Classification Search

CPC . F02M 61/20; F02M 21/0263; F02M 51/0667
USPC ..... 123/470, 490; 239/585.1; 251/129.15
See application file for complete search history.

(56) References Cited

U.S. PATENT DOCUMENTS 5,190,221 A 3/1993 Reiter
5,236,174 A 8/1993 Vogt et al.
5,769,391 A 6/1998 Noller et al.
5,944,262 A 8/1999 Akutagawa et al.
6,510,841 B1 * 1/2003 Stier ..... F02M 51/0685 123/472
6,520,434 B1 2/2003 Reiter
(Continued)

FOREIGN PATENT DOCUMENTS

DE 102015217513 A1 3/2017
DE 102017207845 A1 11/2018
(Continued)

OTHER PUBLICATIONS

PCT Invitation to Pay Additional Fees and, where Applicable, Protest Fee with Annex to Form PCT/ISA/206 Communication Relating to the Results of the Partial International Search for International application No. PCT/US2022/031142 filed May 26, 2022; dated Aug. 31, 2022; 12 pgs.
(Continued)

*Primary Examiner* — Hai H Huynh
(74) *Attorney, Agent, or Firm* — Alix, Yale & Ristas, LLP

(57) ABSTRACT

An electromagnetic fuel injection valve includes a coupling between an armature and the valve member that allows limited relative movement of the valve member and armature in both the opening and closing directions of the valve member. An injector body includes a non-magnetic section to focus magnetic flux and attractive force through the armature and pole. A modular power group reduces the cost of assembly and includes a plastic encapsulated coil that is protected from environmental moisture and corrosion. A valve seat incorporates a valve seal which improves fuel flow past the valve member when the fuel injection valve is in the open position.

16 Claims, 16 Drawing Sheets

(56) References Cited

U.S. PATENT DOCUMENTS

| | | | | |
|---|---|---|---|---|
| 6,607,143 | B2 | 8/2003 | Dallmeyer et al. | |
| 6,619,269 | B1 * | 9/2003 | Stier | F02M 61/20 123/490 |
| 7,007,870 | B2 | 3/2006 | Noller et al. | |
| 7,819,344 | B2 * | 10/2010 | Abe | F02M 51/0653 239/533.9 |
| 7,946,274 | B2 * | 5/2011 | Hayatani | F02M 51/0685 251/129.15 |
| 8,113,177 | B2 | 2/2012 | Hayatani et al. | |
| 8,505,835 | B2 | 8/2013 | Scheffel | |
| 8,671,912 | B2 | 3/2014 | Eisenmenger et al. | |
| 9,903,327 | B2 | 2/2018 | Izzo et al. | |
| 9,920,726 | B2 | 3/2018 | Suzuki et al. | |
| 10,197,028 | B2 | 2/2019 | Yasukawa et al. | |
| 10,330,062 | B2 | 6/2019 | Marchi et al. | |
| 10,428,778 | B2 | 10/2019 | Yamamoto et al. | |
| 10,711,749 | B2 * | 7/2020 | Jovovic | F02M 51/0685 |
| 10,871,134 | B2 * | 12/2020 | Grandi | F02M 61/188 |

FOREIGN PATENT DOCUMENTS

| | | | |
|---|---|---|---|
| EP | 3009663 | B1 | 6/2020 |
| WO | 2017063972 | | 4/2017 |
| WO | 2018001829 | A1 | 1/2018 |

OTHER PUBLICATIONS

Search Report and Written Opinion.

* cited by examiner

FUEL INJECTOR

BACKGROUND

The present disclosure concerns a fuel injector. More specifically, a fuel injector for injecting fuel in an internal combustion engine in a motor vehicle.

A fuel injector for injecting fuel into a combustion engine comprises a valve driven by means of an electrically driven actuator against the force of a closure spring. The disclosed fuel injector includes improvements that promote fast opening and closure of the valve in an electromagnetically actuated valve, while avoiding instability in the valve components that may cause unintended fuel delivery.

SUMMARY OF THE DISCLOSURE

A disclosed fuel injector uses an electromagnetic fuel injection valve to control injection of fuel into a combustion engine. The body of the fuel injector is a metal fuel tube that contains the fuel handling components of the valve and defines a fuel flow path from an inlet to a tip of the fuel injector that may project into an engine cylinder. A valve member is coupled to an axially extending needle and armature of a solenoid that opens the valve under control of an engine control system. The solenoid includes a pole fixed to the injector body, a solenoid coupled to the valve needle and a coil surrounding the injector body where the coil generates magnetic flux through the pole and armature to attract the armature to the pole and open the valve.

In one embodiment of the disclosed fuel injector the valve needle extends axially through the armature and the armature is coupled to the valve needle between first and second armature stops fixed to the valve needle. The stops are spaced apart from each other along the valve needle an axial distance that is greater than an axial length of the actuator where the actuator contacts the stops, allowing limited relative movement between the armature and the valve needle. An embodiment of the armature defines an axial recess surrounding the valve needle and an armature spring biased between a bottom of the axial recess and a first (upper) armature stop biases the armature toward the second (lower) armature stop to define a gap between the armature and the first (upper) armature stop. A valve closing (return spring) bears on an upper surface of the first (upper) armature stop to bias the valve needle toward the closed position of the valve with the valve member in contact with a valve seal to close the fuel injection valve. The valve needle is held in the closed position by the valve closing (return) spring while the armature is biased toward the second (lower) armature stop and spaced apart from the first (upper) armature stop. The first (upper) armature stop is situated between the armature and the pole, while the second (lower) armature stop is arranged between the armature and the valve member.

The armature has a first position axially spaced from the pole to define a first axial gap between the armature and the pole when the valve needle is in the closed position and a second position in contact with the pole when the valve needle is in the open position. The first (upper) and second (lower) armature stops are secured in fixed positions to the valve needle, with the armature axially moveable relative to the valve needle between the first and second armature stops and biased toward the second (lower) armature stop by an armature spring between the armature and the first (upper) armature stop to define a second axial gap between the armature and the first (upper) armature stop when the valve is in the closed position. A return spring is in contact with an upper surface of the first (upper) armature stop for biasing the valve needle away from the pole and toward the closed position. The disclosed coupling between the armature and valve needle separates the momentum changes and impacts of the armature and valve needle in both the opening and closing directions of the fuel injection valve. The disclosed configuration of a valve needle, armature, armature stops and armature spring de-couples the mass of the armature from the valve needle to reduce transmission of impact and changes of momentum from the armature to the valve needle, reducing unintended movement (bouncing) of the valve member and reducing the associated unintended fueling. The disclosed coupling between the armature and valve needle has inventive significance apart from other aspects of the disclosed fuel injector and can be used in conjunction with some, all or none of the other aspects of the disclosed fuel injector.

The disclosed coupling between the armature and valve needle may be further specialized where the armature defines an axial recess, and the armature spring is positioned in the axial recess and biased between a bottom of the axial recess and a lower surface of the second armature stop. An embodiment of the armature may define at least one fuel flow passage communicating between the axial recess and an area between the armature and the valve member. An embodiment of the first (upper) armature stop may radially span the axial recess and includes at least one notch on the flange allowing fluid communication from an area between the first (upper) armature stop and the pole and the axial recess. The at least one notch, axial recess, and at least one fuel flow passage permitting fluid communication from the area between the first (upper) armature stop and the pole to the area between the armature and the valve member, e.g., in the direction of fuel flow toward the injector nozzle tip. An embodiment of the armature may define the first and second armature stops both include a periphery defining at least one notch. An embodiment of the first (upper) armature stop may include a radially projecting flange captured axially between the pole and the armature where the distance between the armature and the pole is greater than an axial thickness of the flange, allowing limited axial movement of the valve needle in the opening direction after the armature contacts the pole, though such axial movement of the valve needle is resisted by the valve closure (return) spring and may not actually occur. The disclosed arrangement separates the impact of the armature with the pole from the valve needle, so energy from the impact and change of momentum of the armature is not directly transferred to the valve needle. The refinements of the disclosed coupling between the armature and valve needle may be selected for inclusion in a fuel injector as needed.

Another aspect of the disclosure relates to improvements in a magnetic circuit that applies magnetic force to the armature to move the armature toward the pole and open the fuel injection valve against the bias of a valve closure (return) spring. The valve body includes a magnetic upper portion, a non-magnetic intermediate portion, and a magnetic lower portion. The upper portion, intermediate portion, and lower portion are integrally connected to define an uninterrupted cylindrical side wall of the valve body. The armature and pole are arranged in the valve body with an axial gap between the armature and coil surrounded by the non-magnetic intermediate portion of the valve body. A coil surrounds the non-magnetic intermediate portion of the valve body and when energized generates magnetic flux through the pole and armature to attract the armature to the pole. The armature is coupled to the valve needle to move the valve needle toward the open position when the armature is magnetically attracted toward the pole. Since magnetic flux will follow the path of least resistance, the non-magnetic portion of the valve body forces flux to flow through the pole and armature, rather than through the valve body, which improves the force on the armature when the coil is energized. The disclosed magnetic circuit of an embodiment of a fuel injector make the fuel injector more energy efficient and improve the opening speed of the fuel injector. The disclosed magnetic circuit can be employed independent of the disclosed coupling between the armature and valve needle and other aspects of the disclosed fuel injector. The disclosed improvements to the magnetic circuit in an electromagnetic fuel injection valve have inventive significance apart from the other disclosed improvements and can be incorporated into a fuel injector apart from other aspects of the disclosed fuel injector.

According to a further aspect of the disclosed fuel injector, a modular power group secures the coil to the valve body and completes a magnetic circuit directing magnetic flux through the pole and armature of an electromagnetic fuel injection valve. An embodiment of a modular power group includes a coil assembly, including an annular coil with conductors extending from the annular coil to an electrical connector, the annular coil embedded in plastic that surrounds the conductors and at least partially forms the electrical connector. A first flux washer surrounds the valve body at one axial end of the coil, a cylindrical housing in contact with the first flux washer and outwardly surrounding the coil, and a second flux washer in contact with the cylindrical housing and extending around a majority of a circumference of the valve body at a second axial end of the coil form a radially outer part of the magnetic circuit for flux generated when the coil is energized. The first flux washer, cylindrical housing and second flux washer form part of a magnetic circuit extending through the armature and pole. The coil generates a magnetic field in the magnetic circuit when energized, and the magnetic field attracts the armature to the pole to move the valve needle toward the open position. The modular power group is of inventive significance apart from the other disclosed aspects of a fuel injector and can be incorporated into a fuel injector separately from the other disclosed improvements.

An embodiment of the modular power group of the fuel injector can be further specialized wherein the valve body is connected to an inlet to form a sealed fuel tube and the inlet includes features mating with the coil assembly to retain the coil assembly to the fuel injector. An embodiment of the armature may include the first flux washer, cylindrical housing and second flux washer are welded to each other after assembly to the valve body. In one embodiment the second flux washer is interrupted by a slot and the conductors extend axially through the slot to the electrical connector. This allows the second flux washer to be installed after the coil assembly is inserted into an annular space defined between the valve body and the cylindrical housing.

Another aspect of the disclosure relates to an improved valve seat configuration. A fuel injection includes a valve needle is connected to a spherical valve member and moveable along a longitudinal axis between a closed position and an open position. The valve seat defines a valve seal is in contact with an outside surface of the spherical valve member when the valve needle is in the closed position. The valve seal comprises an annular conical surface surrounding a fuel sac. The outside surface of the spherical valve member contacts the valve seal along a line where the valve seal is tangent to the outside surface. The conical surface extends radially inward a first distance to the fuel sac and radially outwardly a second distance approximately equal to the first distance. The conical valve seal surface may include a back cut defining an outer boundary of the valve seal. The position of an annular line of contact between the spherical valve member and the conical valve seal can be adjusted by altering the angle and radial position of the inner and outer boundaries of the valve seal. Embodiments of the valve seat may include guide surfaces arranged to guide axial movement of the spherical valve member between the open and closed positions to maintain alignment between the valve member and the valve seal. The guide surfaces may be portions of a cylinder concentric with a longitudinal axis of the fuel injector. The improved seat configuration is of inventive significance by itself and can be employed independent of the other aspects of the disclosed fuel injector.

DETAILED DESCRIPTION

Figure 1:
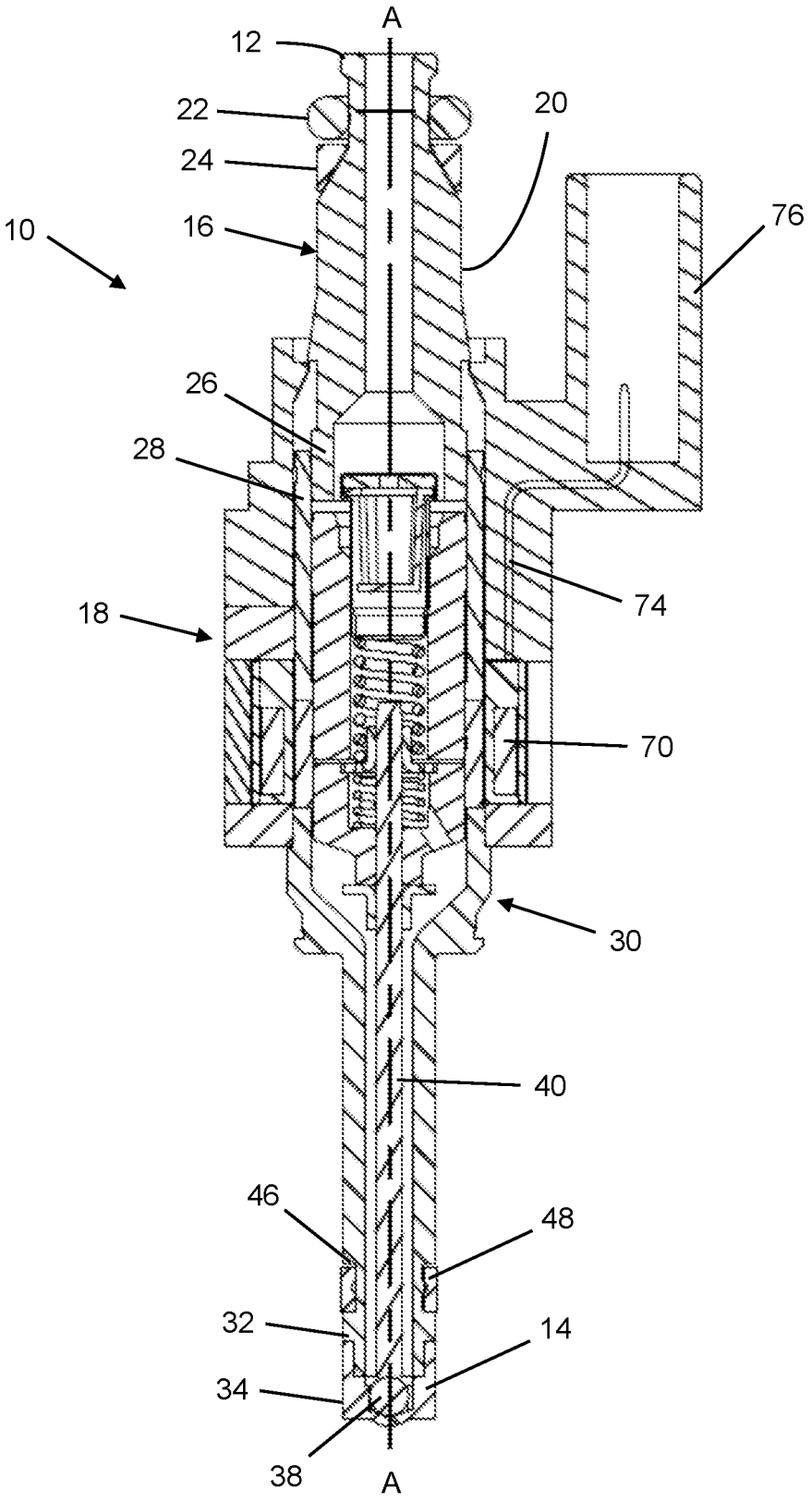
FIG. 1 is a longitudinal sectional view through an embodiment of a fuel injector according to aspects of the disclosure.

Referring to FIGS. 1-7, a solenoid actuated fuel injector 10 dispenses a quantity of fuel that is to be combusted in an internal combustion engine (not shown). The fuel injector 10 extends along a longitudinal axis A-A between an inlet end 12 and an injection end 14 and includes a fuel tube assembly 16 and a power group assembly 18. The fuel tube assembly 16 contains the "wet" part of the fuel injector 10 that performs fluid handling functions, e.g., defining a fuel flow path from the inlet end 12 to the injection end 14 and allowing or prohibiting flow of fuel from the injection end 14 of the fuel injector 10. The power group assembly 18 converts electrical signals to a driving force used to open a valve contained in the fuel tube assembly 16 to permit fuel flow from the injection end 14 of the fuel injector 10.

Figure 2:
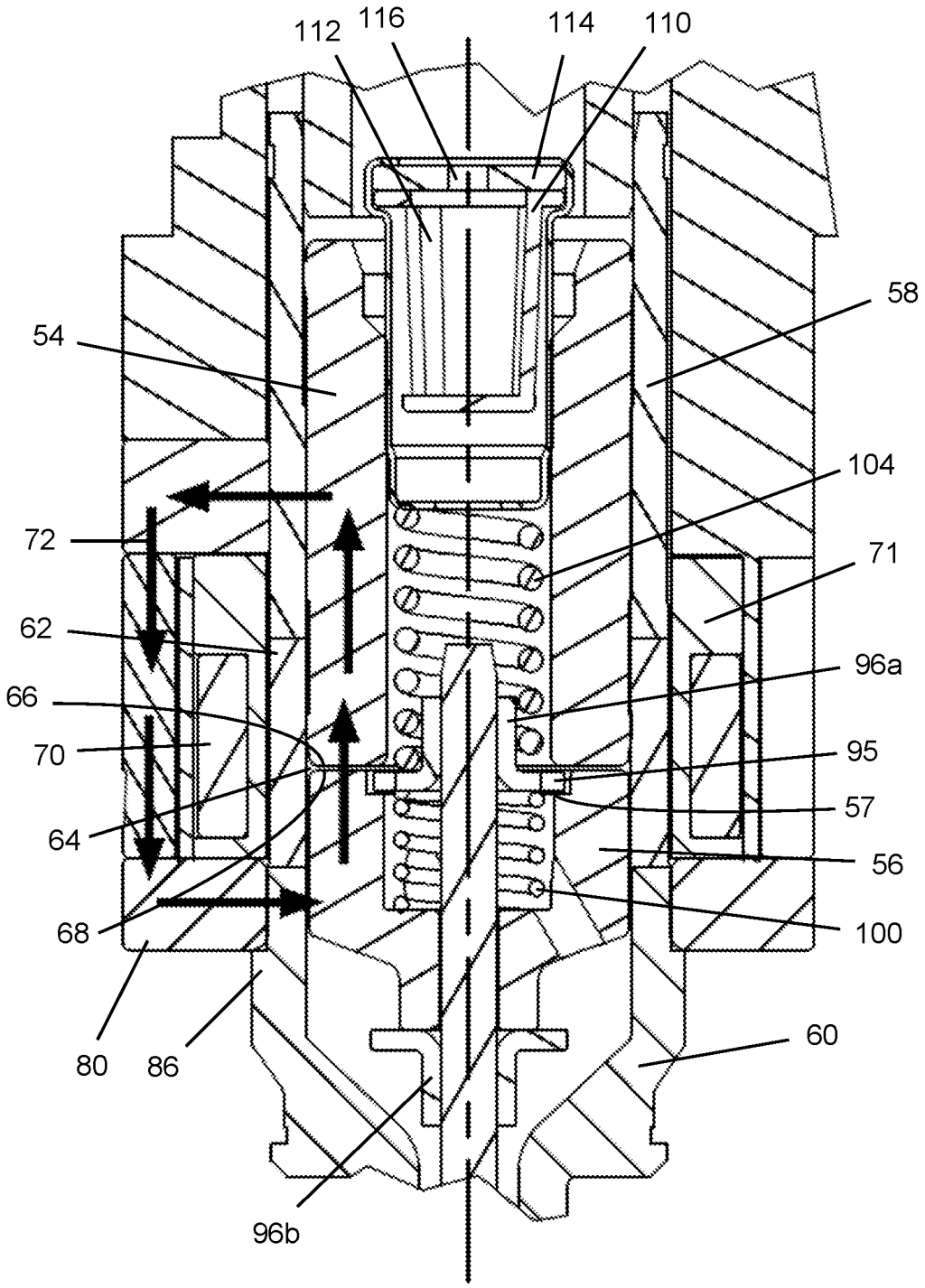
FIG. 2 is an enlarged portion of the sectional view of FIG. 1.
Figure 10:
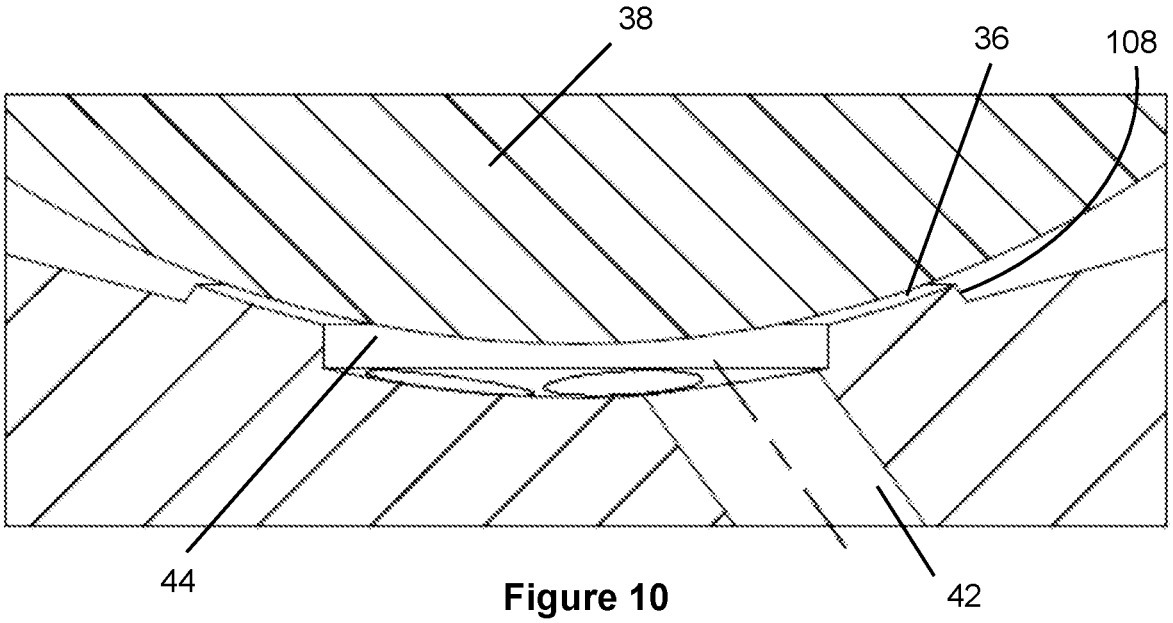
FIG. 10 is an enlarged, partial sectional view of the valve seat and spherical valve member of FIG. 8.
Figure 11:
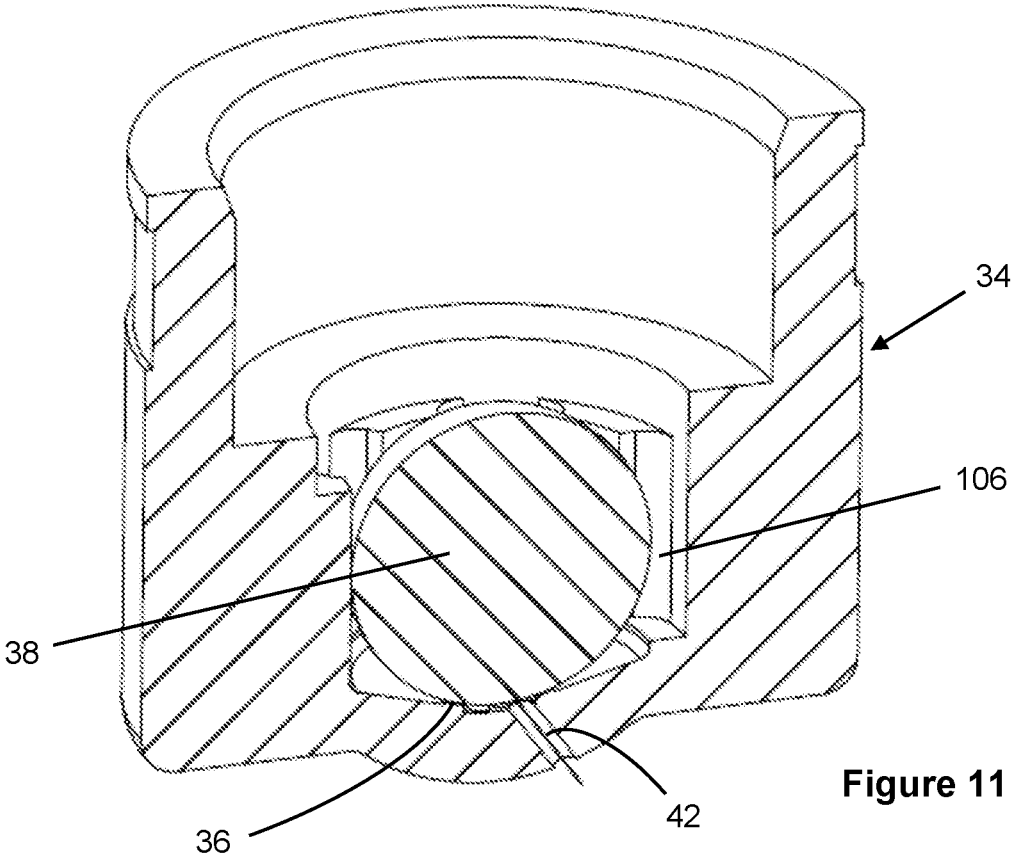
FIG. 11 is a perspective sectional view of the valve seat and spherical valve member of FIG. 8.
Figure 17:
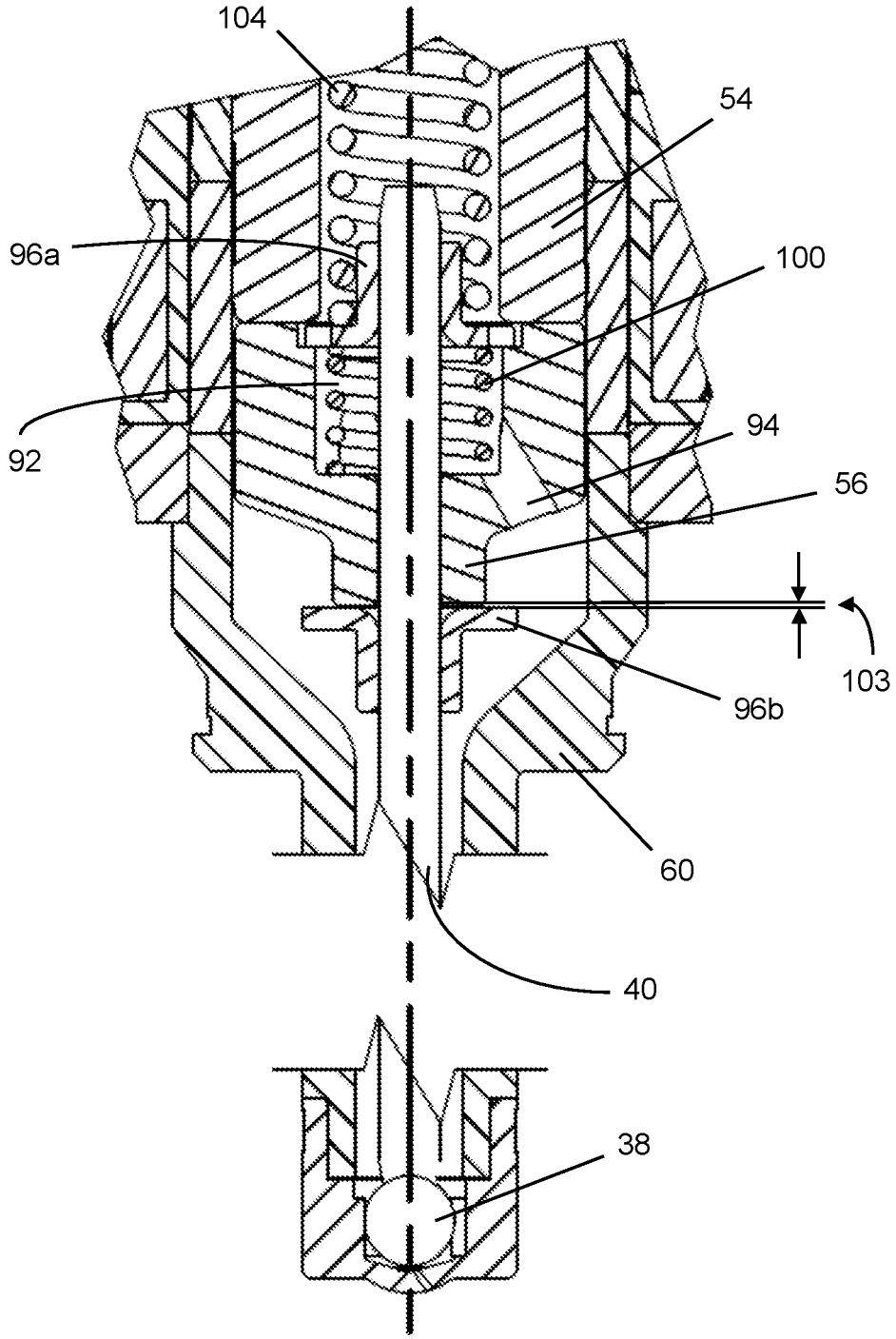
FIG. 17 is an enlarged longitudinal sectional view through a portion of an embodiments of the disclosed fuel injector, showing the position of the armature, valve needle, and valve member relative to the pole and valve seat when the valve is fully open.

FIGS. 1 and 2 are cross sectional views through an embodiment of a disclosed fuel injector 10 according to aspects of the disclosure. The fuel tube assembly 16 includes an inlet 20 with a sealed connection to a fuel distributor line (not shown). The sealed connection includes an O-ring 22 and back up washer 24 that cooperate with a coupling on the fuel distributor line to compress the O-ring 22, resulting in a sealed connection that is capable of withstanding fuel pressures from 350 bar up to 1000 bar. From the sealed connection, the inlet 20 extends to an annular, open second end 26 that is received within an open upper end 28 of a valve body 30. The valve body 30 extends from its connection with the inlet 20 to an opposite end that includes a tip 32 connected to a valve seat 34. The valve seat 34 includes an inward facing valve seal 36 that cooperates with a valve member 38 connected at one end of a valve needle 40. The valve seat 34 defines a plurality of fuel injection orifices 42 communicating with a fuel sac 44 bounded by the valve seal 36. When the valve member 38 is biased into contact with the valve seal 36, pressurized fuel in the fuel tube assembly 16 above the valve member 38 is prevented from passing into the fuel sac 44 and out of the fuel injection orifices 42, and when the valve member 38 is moved away from the valve seal 36 as shown in FIGS. 10 and 17, fuel passes between the valve member 38 and valve seal 36, through the fuel sac 44 and out fuel injection orifices 42. In use, the tip 32 of the fuel injector 10 extends through the cylinder head of an internal combustion engine (not shown) to position the valve seat 34 and its fuel injection orifices 42 in a cylinder of an internal combustion engine as is known in the art. A groove 46 on the tip 32 above the valve seat 34 supports a compression seal 48 which cooperates with a bore in the cylinder head (not shown) to contain pressurized gasses in the engine cylinder.

Figure 7:
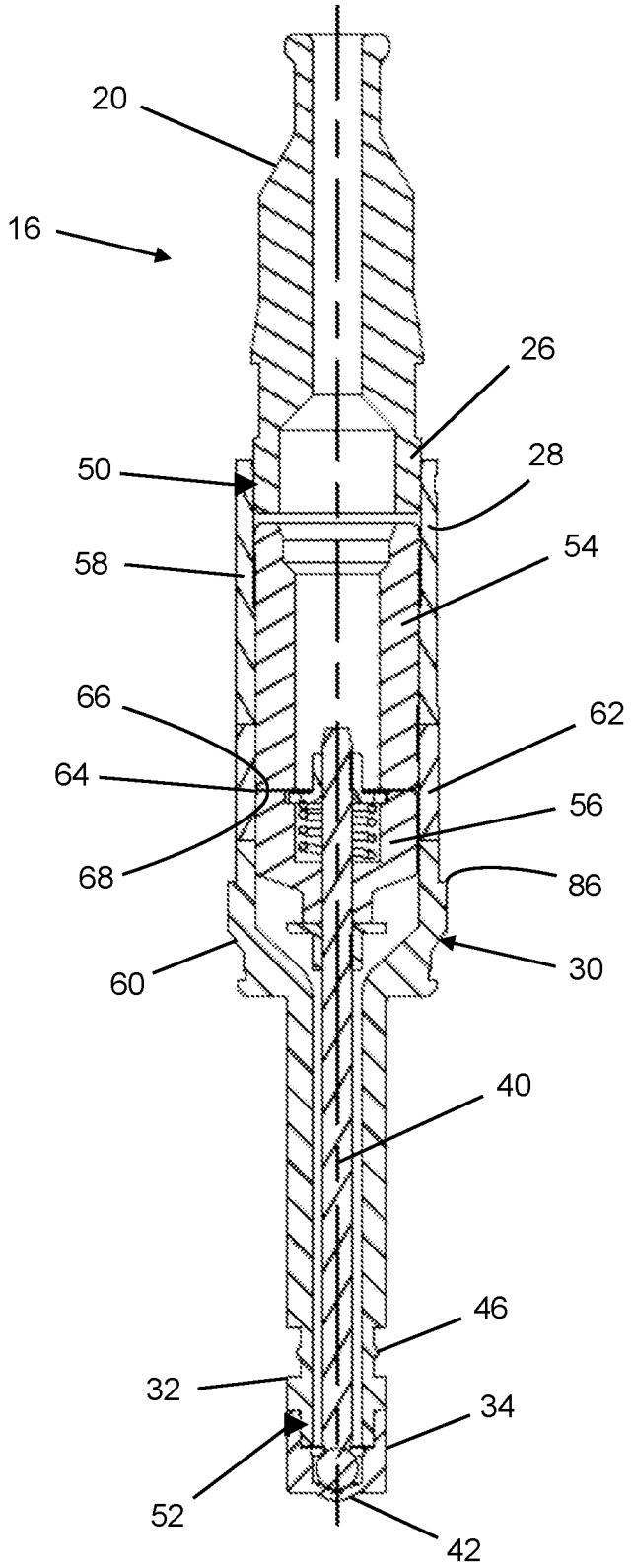
FIG. 7 is a longitudinal sectional view through a fuel module incorporating the valve body of FIG. 6 in an assembled state showing internal components.
Figure 8:
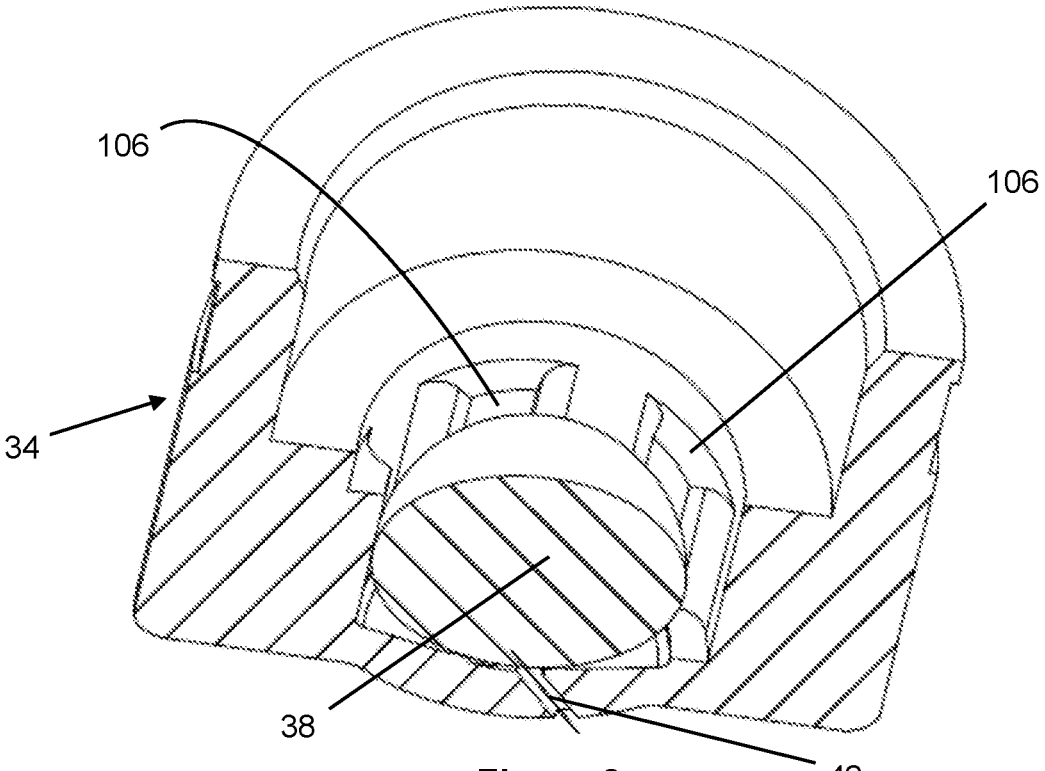
FIG. 8 is an enlarged perspective sectional view of a valve seat and spherical valve member compatible with the disclosed embodiment of a fuel injector illustrated in FIGS. 1-8.
Figure 9:
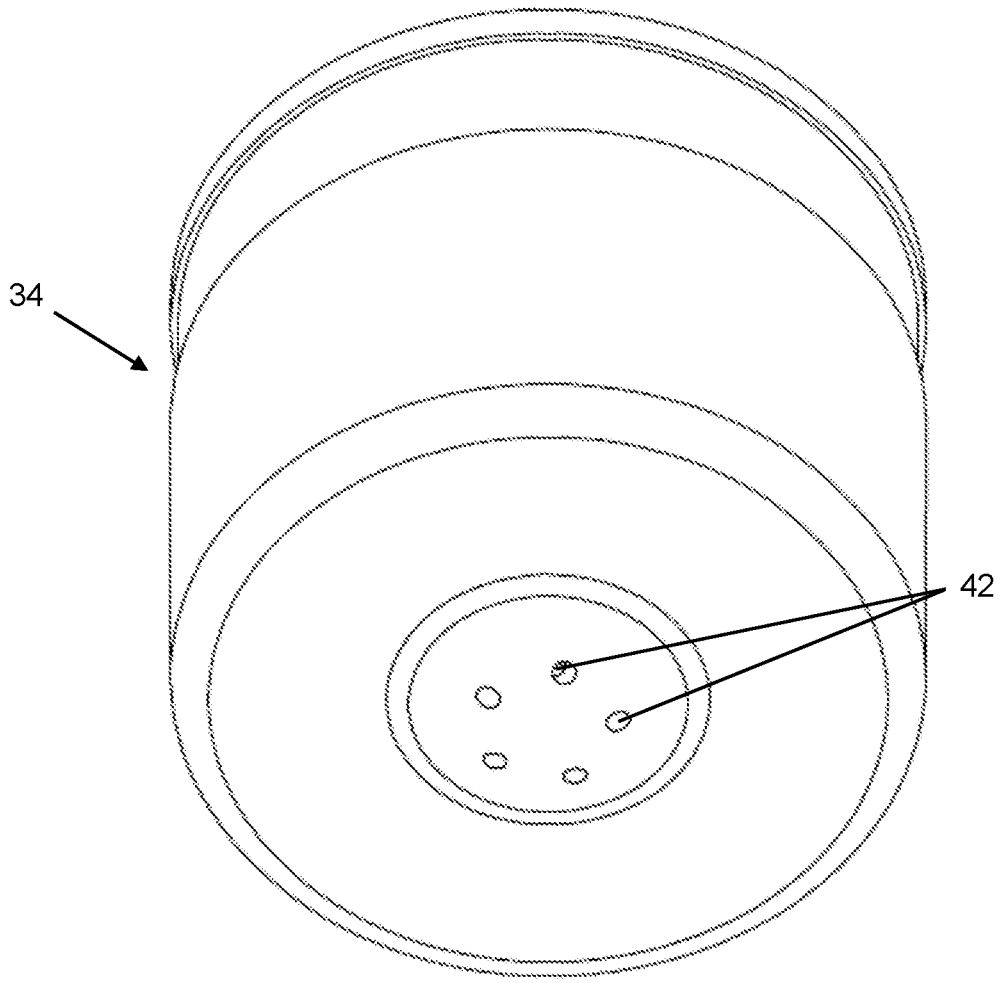
FIG. 9 is a bottom perspective view of the valve seat of FIG. 8.

As shown in FIG. 7, the fuel tube assembly 16 includes the inlet 20, the valve body 30 and the valve seat 34, which form a sealed enclosure surrounding fuel handling components of the fuel injector 10. The lower end 26 of the inlet 20 is received within the upper end 28 of the valve body 30 and connected by a weld 50. The valve seat 34 surrounds a lower end of the tip 32 of the valve body 30 and is connected by a weld 52. The welds 50, 52 may be laser welds extending around the respective joints to produce a hermetically sealed fuel tube assembly 16. The fuel tube assembly 16 defines a fuel flow path extending from the inlet 20 to the fuel injection orifices 42. A magnetic pole 54 and armature 56 are arranged within the fuel tube assembly 16 so that magnetic force from the power group assembly 18 attracts the armature 56 toward the pole 54. The armature 56 is coupled to the valve needle 40 and moves the valve member 38 away from the valve seal 36 when the armature 56 is attracted to the pole 54. According to aspects of the disclosure, the valve needle 40 with attached armature 56 and pole 54 are assembled into the valve body 30 before the inlet 20 is inserted and welded to the valve body 30.

Figure 6:
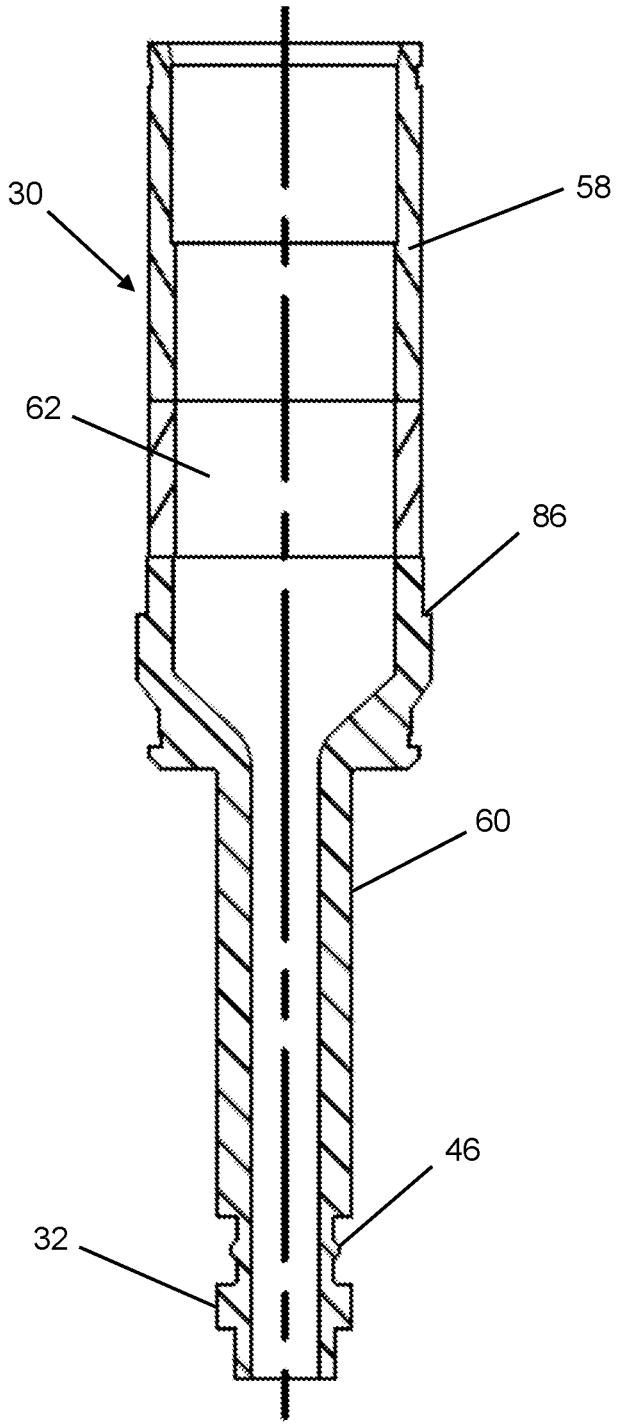
FIG. 6 is a longitudinal sectional view through a fuel injector valve body according to aspects of the disclosure.

The upper valve body 58 where the valve body 30 connects to the inlet 20 is constructed of magnetic steel and the lower valve body 60 that includes the tip 32 is also constructed of magnetic steel. As best seen in FIG. 6, an intermediate portion 62 of the valve body 30 is constructed of non-magnetic metal and is integrally connected to the upper valve body 58 and lower valve body 60. According to aspects of the disclosure, the integral connection between the upper valve body 58, non-magnetic intermediate portion 62, and lower valve body 60 is formed before the valve body 30 is machined into its final shape, resulting in a seamless, leak free tubular valve body 30 surrounding the pole 54 and armature 56 where the magnetic and non-magnetic portions of the valve body 30 are precisely aligned. The non-magnetic intermediate portion 62 of the valve body 30 is positioned at a location that surrounds and axially overlaps with the gap 64 present between the lower end face 66 of the pole 54 and the upper end face 68 of the armature 56 when the valve is in the closed position. As shown in FIG. 2, the non-magnetic material of the intermediate portion 62 valve body 30 at this location forces magnetic flux from the solenoid coil 70 to pass entirely through the armature 56 and pole 54 maximizing the force applied to the armature 56 when the coil 70 is energized. Focusing magnetic flux through the pole 54 and armature 56 allows for excellent magnetic feedback for ballistic control of the valve needle 40 and valve member 38.

FIG. 2 illustrates the magnetic circuit 72 in an embodiment of the disclosed fuel injector 10. The power group assembly 18 includes an annular coil 70 that includes conductors 74 extending to a connector 76. The connector 76 electrically connects the coil 70 to a control system (not shown) that applies power to the coil 70 to generate magnetic force applied to the armature 56 to move the armature 56, valve needle 40 and valve member 38 to permit fuel flow through the injector 10. The control system may be an engine control unit (ECU) that coordinates fuel flow through the fuel injectors of an internal combustion engine with other components of the engine. The configuration and operation of such control systems is well-understood by those skilled in the art and will not be further described.

Figure 3:
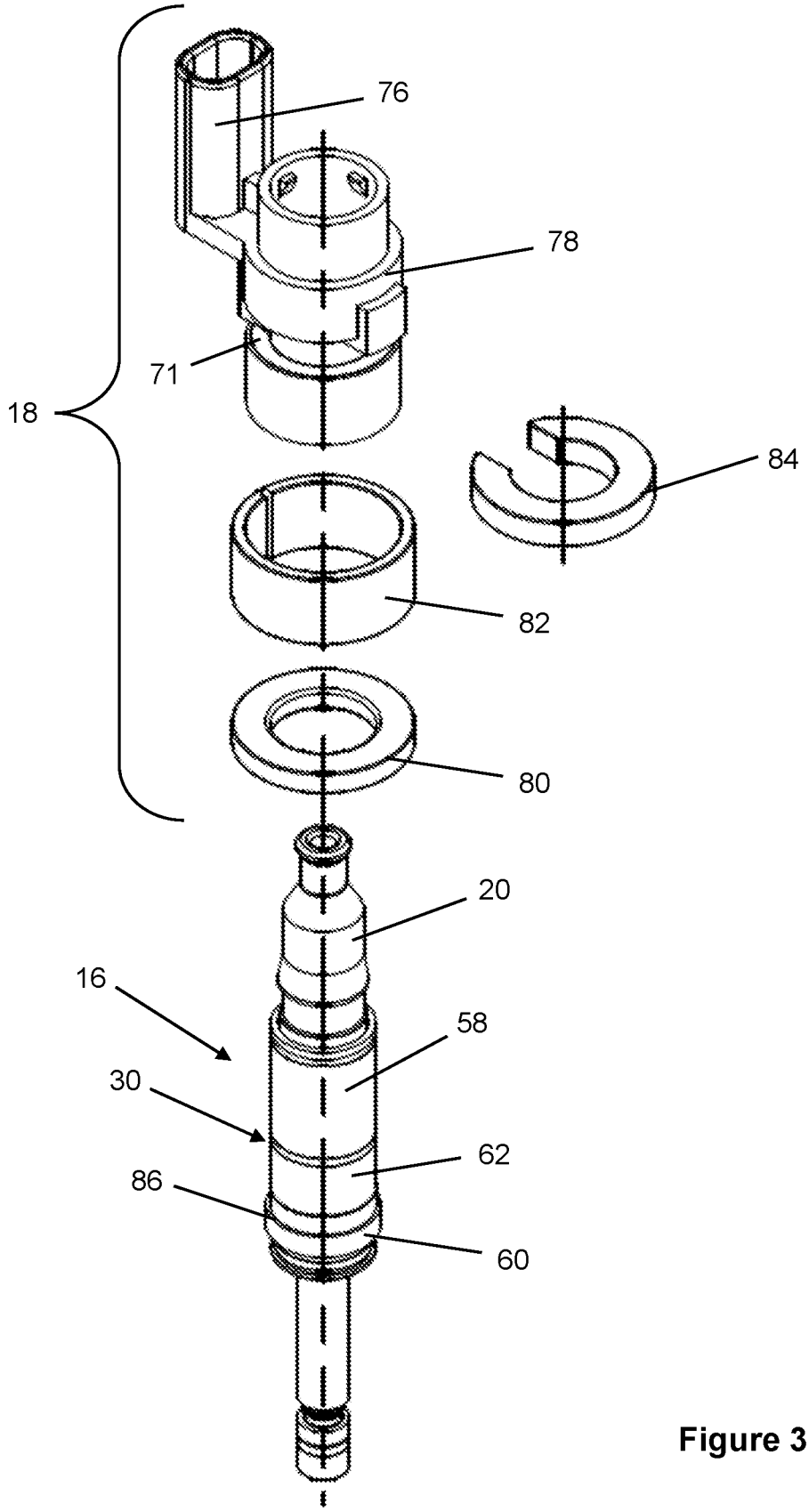
FIG. 3 is a partially exploded perspective view of the fuel injector of FIGS. 1 and 2.
Figure 4:
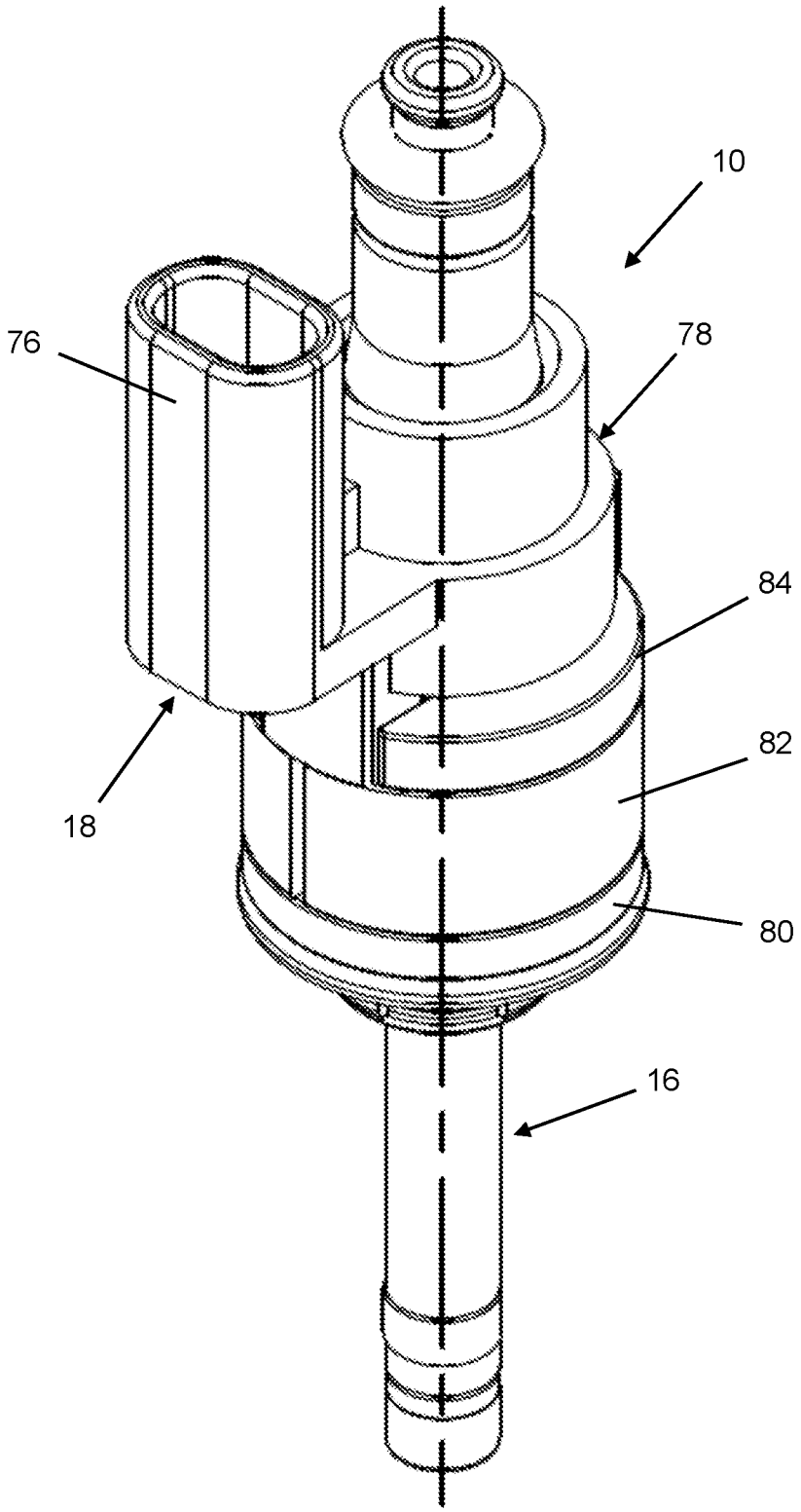
FIG. 4 is an exterior perspective view of the fuel injector of FIG. 3 in an assembled state.

The coil 70 is positioned radially surrounding the non-magnetic intermediate portion 62 of the valve body 30 and the gap 64 between the lower end face 66 of the pole 54 and upper end face 68 of the armature 56. As best seen in FIGS. 3 and 4, the power group assembly 18 is modular, comprising a small number of inexpensive components that are assembled to the outside of the fuel tube assembly 16. The coil 70 is wound on a bobbin 71 and surrounded by injection molded plastic to form a coil assembly 78 shown in FIG. 3. The coil assembly 78 includes conductors 74 that connect the coil 70 to a plug connector 76. The form of plug connector 76 can be changed to be compatible with different electrical connection systems as needed. The power group assembly 18 also includes a lower flux washer 80 a cylindrical housing 82 and a slotted upper flux washer 84 which, together with the magnetic portions 58, 60 of the valve body 30, pole 54 and armature 56 complete the magnetic circuit 72 shown in FIG. 2. The flux washers 80, 84 and cylindrical housing 82 are basic shapes of magnetic material that can be inexpensively produced in large quantities. According to aspects of the disclosure, the coil assembly 78 does not incorporate any of the magnetic components that complete the magnetic circuit shown in FIG. 2, which allows coil assemblies with different plug connectors 76 to be easily incorporated into a fuel injector at low cost for compatibility with different connection systems.

Figure 5:
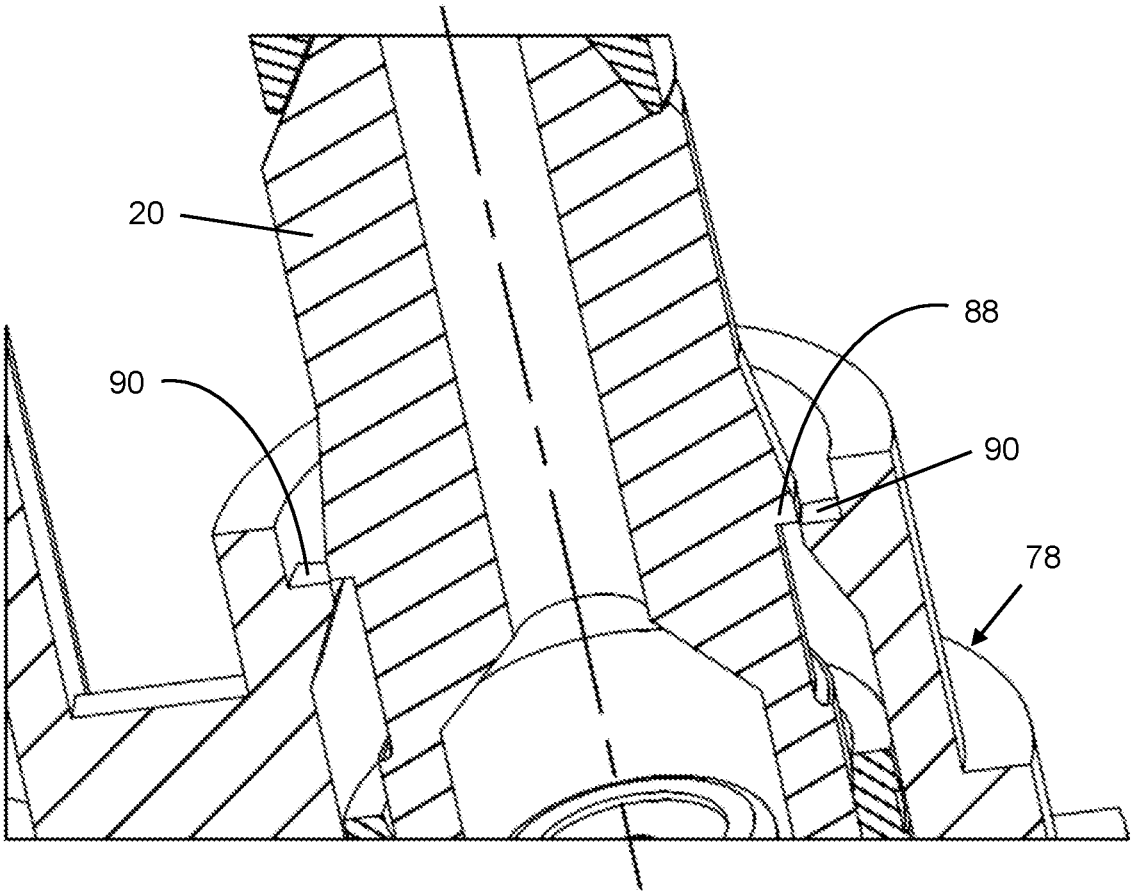
FIG. 5 is an enlarged partial sectional view of the fuel injector of FIG. 4 showing a connection between a coil assembly and the inlet end of the fuel module.

With reference to FIGS. 3 and 5, an embodiment of the modular power group assembly 18 is assembled to the fuel tube assembly 18 as follows: The lower flux washer 80 and cylindrical housing 82 are placed over the valve body 30 with the lower flux washer 80 in contact with an annular shoulder 86 on the valve body 30 and welded in place. The coil 70 of the coil assembly 78 is inserted between the housing 82 and the valve body 30 and axially moved toward the lower flux washer 80 to engage a barb 88 on the inlet 20 with a complementary snap 90 on the inside of the injection molded plastic coil assembly 78 as shown in FIG. 5. This snapped together connection retains the coil assembly 78 to the fuel tube assembly 16 while the upper flux washer 84 is inserted laterally into a complementary slot defined by the coil assembly 78 at the upper end of the housing 82 and welded in place. The upper flux washer 84 holds the coil 70 in place beneath it, while holding the upper part of the coil assembly 78 upward to axially load the barb 88 and snap 90. This configuration securely retains the coil assembly 78 to the fuel tube assembly 16 and allows the inlet 20 to support the upper end of the coil assembly 78 and plug connector 76. After these assembly steps are completed, the power group assembly is retained in an assembled position on the fuel tube assembly 16 as shown in FIG. 4. The lower flux washer 80 is welded to the lower valve body 60 at the shoulder 86, the housing 82 is welded to the lower flux washer 80 and the upper flux washer 84 is welded to the upper end of the housing 82 to ensure that no air gaps interrupt the magnetic circuit 72. According to aspects of the disclosure, the power group assembly 18 is mounted to the fuel injector 10 as a last step in assembling the fuel injector 10.

Figure 12:
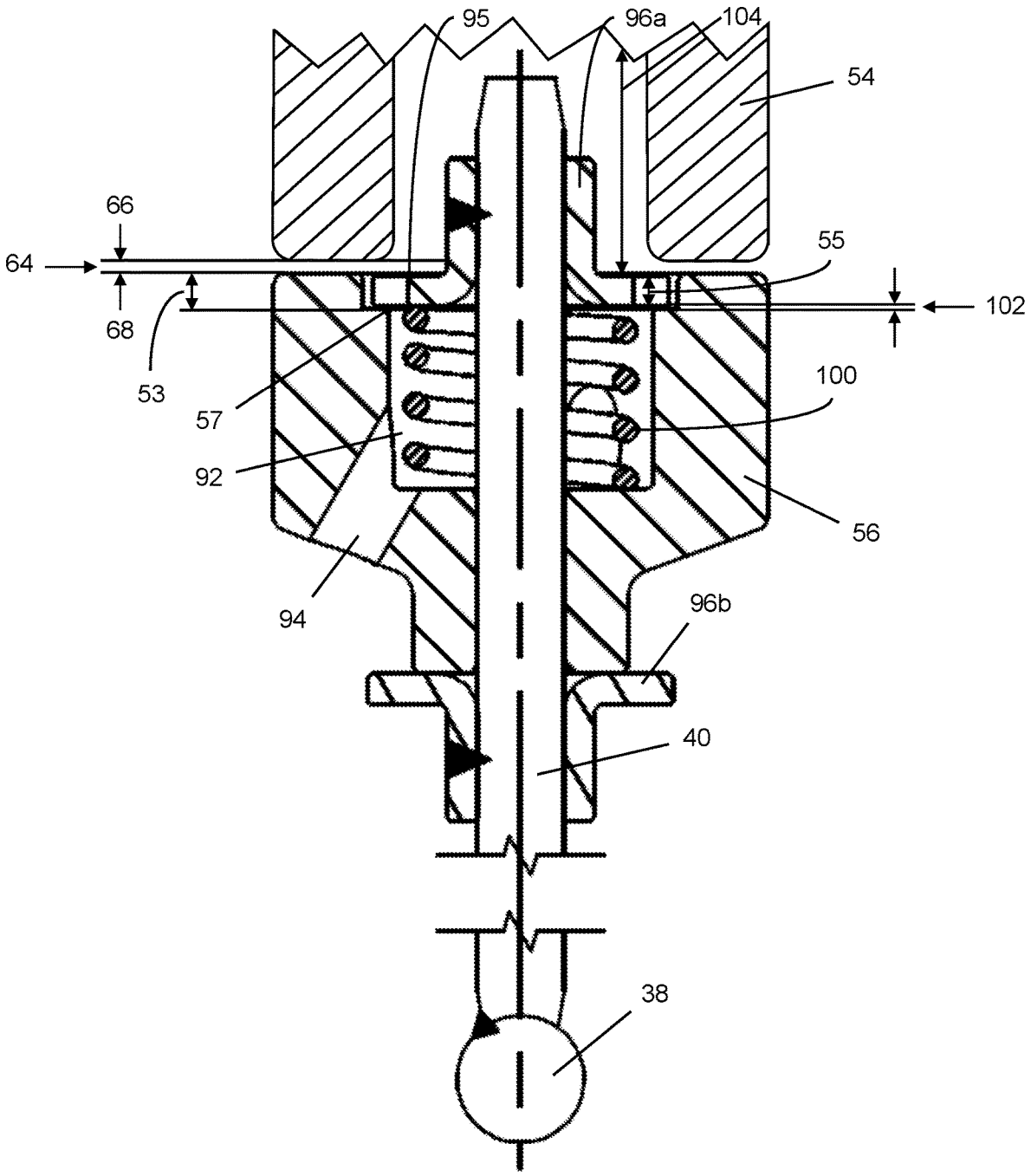
FIG. 12 is a longitudinal sectional view through an armature assembled to a valve needle according to aspects of the disclosure.
Figure 13:
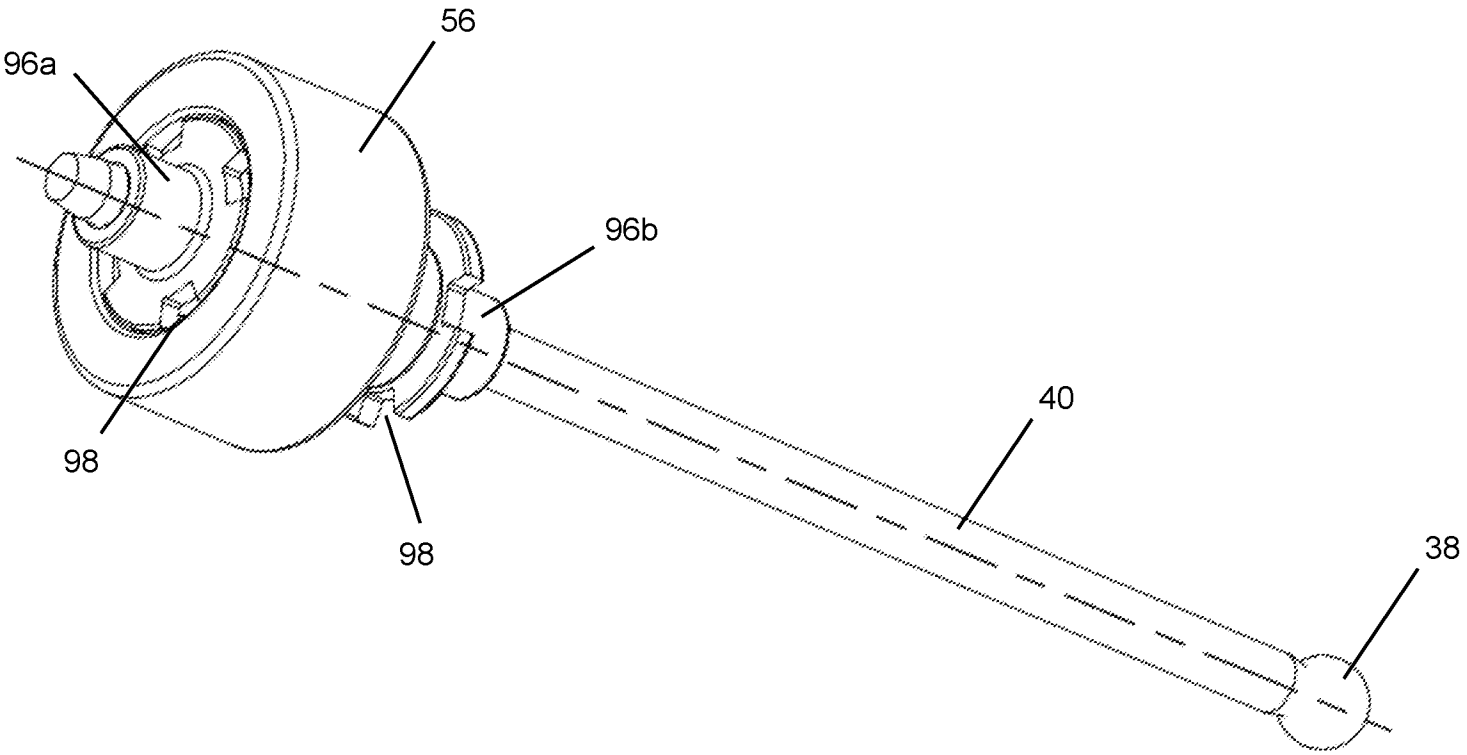
FIG. 13 is a top perspective view of the armature/needle assembly of FIG. 12.
Figure 14:
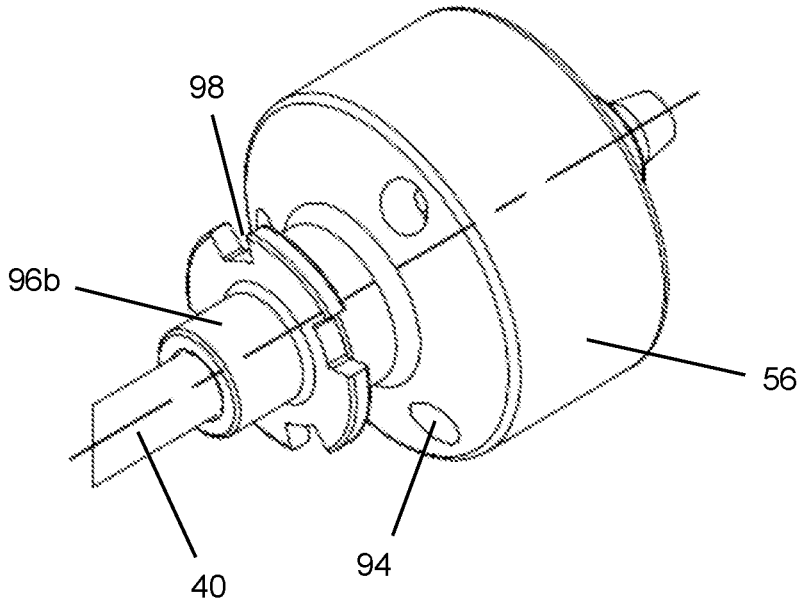
FIG. 14 is a partial bottom perspective view of the armature/needle assembly of FIG. 12.
Figure 15:
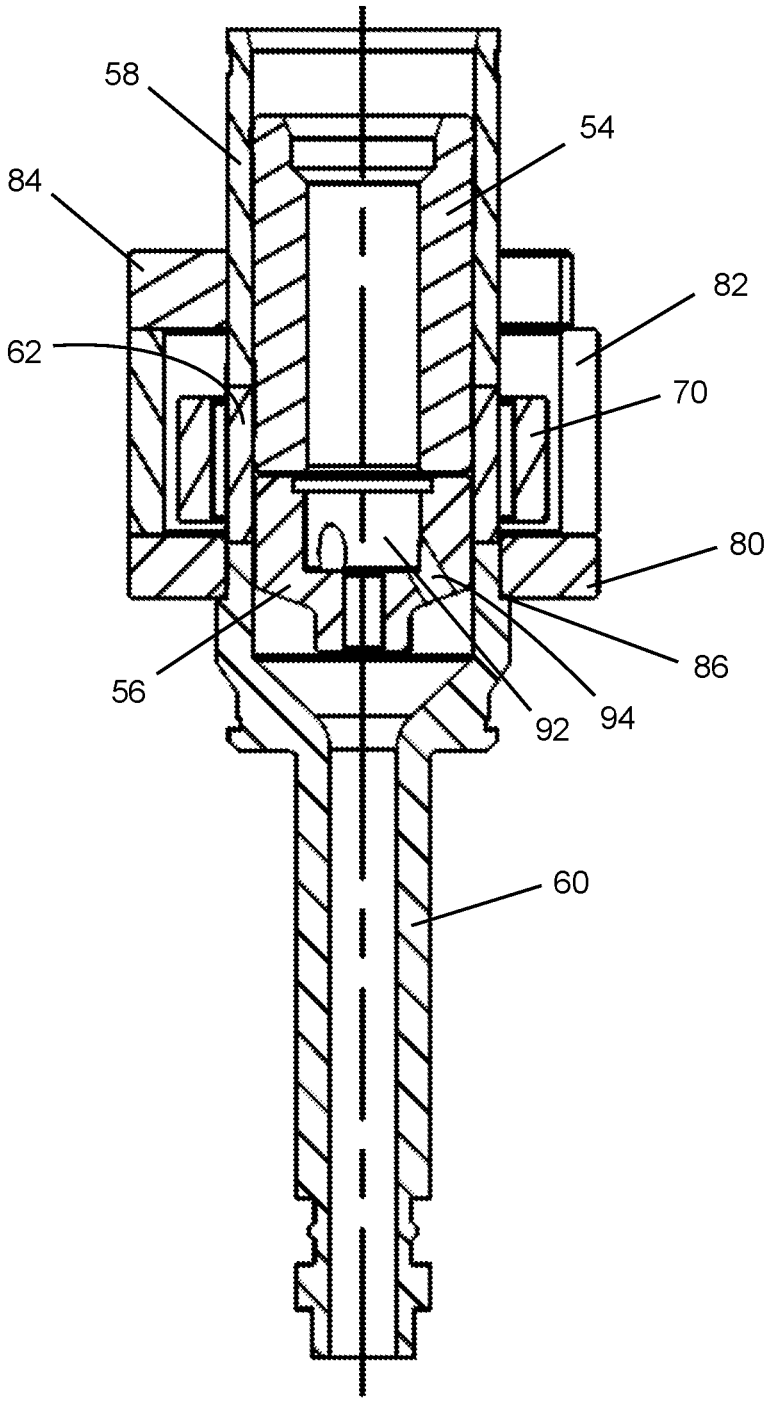
FIG. 15 is a longitudinal sectional view through a valve body in functional conjunction with components that generate magnetic force to open the valve.

FIGS. 12-14 illustrate an embodiment of the valve needle 40 and valve member 38 coupled to the armature 56 according to aspects of the disclosure. The armature 56 defines an axial recess 92 and at least one fuel flow passage 94 from the recess 92 to a region below the armature 56. The fuel flow passage 94 allows fuel to flow through the armature 56 during use of the fuel injector 10. Two substantially identical armature stops 96*a*, 96*b* limit movement of the armature 56 along the valve needle 40 between the stops 96*a*, 96*b*, but the mass of the armature 56 is not directly connected to the valve needle 40 as will be described below. The armature stops 96*a*, 96*b* include notches 98 at their peripheries so that the upper armature stop 96*a* allows fuel to flow into the recess 92 and through the fuel flow passage 94. The notches 98 do not interfere with the function of the lower armature stop 96*b*, so the same component can be used both above and below the armature 56 to reduce cost. The armature stops 96*a*, 96*b* are welded to the valve needle 40 at positions allowing a small amount of relative axial movement between the armature 56 and the valve needle 40. A coil spring 100 is captured in the axial recess 92 of the armature 56 and biased between the upper armature stop 96*a* and the bottom of the recess 92 to bias the armature 56 away from the upper armature stop 96*a* and against the lower armature stop 96*b*. In this arrangement, an axial gap 102 is maintained between the armature 56 and the upper armature stop 96*a* when the valve is closed as shown in FIGS. 1 and 12. The relative positions of the upper armature stop 96*a* and armature shown 56 in FIG. 12 correspond to a state where the coil 70 is not energized and the spring 100 biases the armature 56 away from the upper armature stop 96*b* to open gap 102. When the coil 70 is energized, the axial gap 102 allows the armature 56 to accelerate rapidly toward the pole 54 for a predetermined distance defined by gap 102 before the shoulder 57 of the armature contacts the flange 95 of the upper armature stop 96*a*, causing the valve needle 40 and valve member 38 to move away from the valve seal 36. During this initial stage of opening the fuel injector valve, the magnetic force applied to the armature 56 compresses the armature spring 100 to close gap 102. The kinetic energy of the accelerated armature 56 and the narrowing of the gap 64 between the armature 56 and the pole 54 rapidly moves the valve needle 40 and valve member 38 away from the valve seal 36 to begin injection of fuel.

Figure 16:
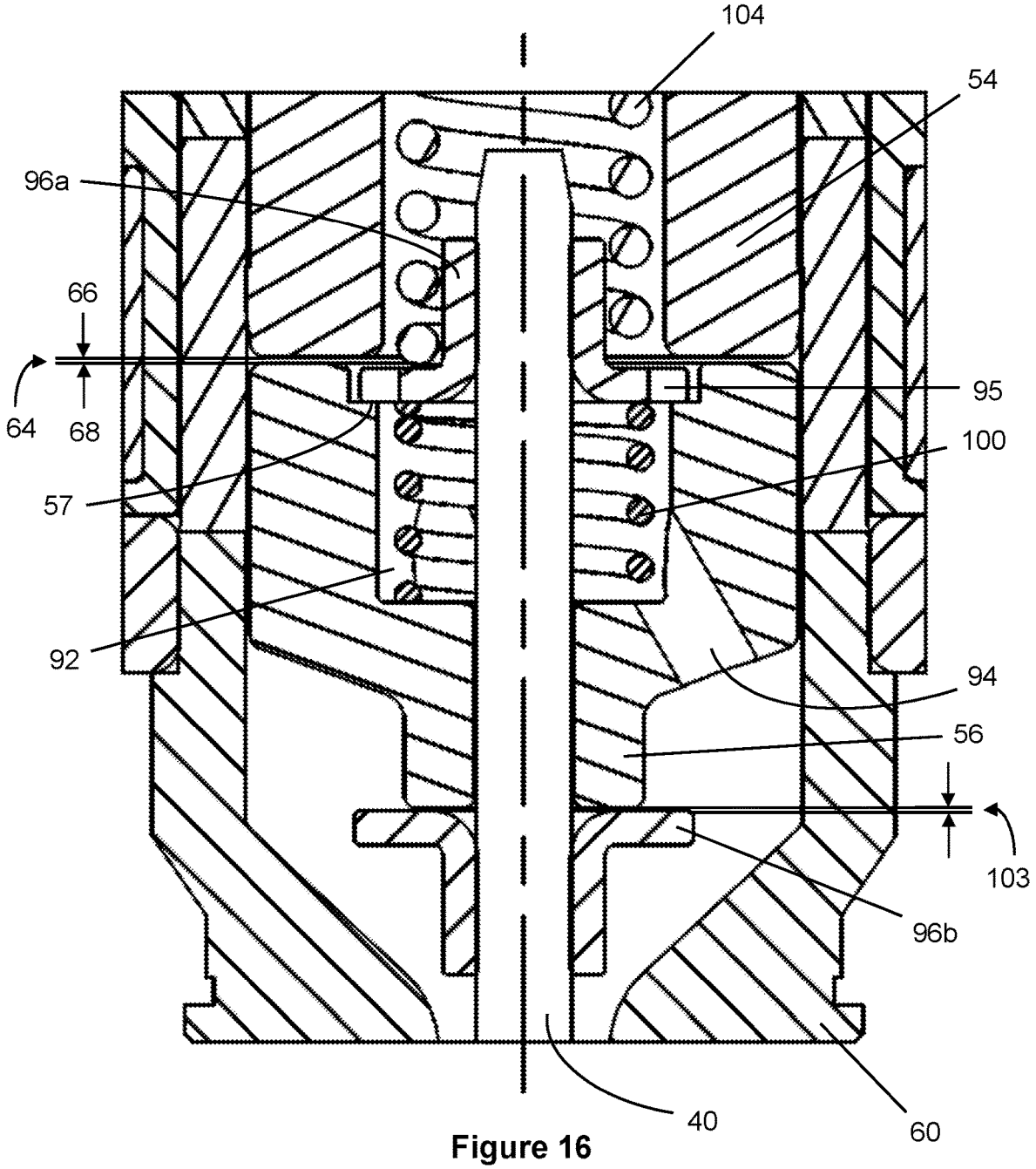
FIG. 16 is an enlarged longitudinal sectional view through a portion of an embodiment of the disclosed fuel injector, showing the position of the armature and valve needle relative to the pole during an initial stage of valve opening.

The lift or stroke of the valve needle 40 and valve member 38 are defined by the axial gap 64 between the upper end face 68 of the armature 56 and the lower end face 66 of the pole 54 minus the gap 102 between the armature and the upper armature stop. In one embodiment of the disclosed fuel injector, gap 64 is at least twice as large as gap 102. In other embodiments of a fuel injector according to aspects of the disclosure, the ratio of gap 64 to gap 102 can be between 2:1 and 4:1. Keeping gap 102 small relative to gap 64 permits acceleration of the armature 56 against only the bias of armature spring 100 without significantly delaying opening of the injector valve. During a valve opening event, the armature 56 begins moving toward the pole 54, closes the gap 102 and contacts the upper armature stop 96*a* as shown in FIG. 16. In FIG. 16, armature spring 100 is compressed, gap 102 between the shoulder 57 of the armature and flange 95 of upper armature stop 96*a* is closed, gap 103 is opened between the lower end of the armature 56 the lower armature stop 96*b*, gap 64 between the upper end face 68 of the armature 56 and the lower end face 66 of the pole 54 has narrowed, but the valve needle 40 has not yet begun to move in the opening direction. When gap 102 has closed, the armature 56 is in contact with upper armature stop 96*a* and begins moving the valve needle 40 against the bias of the valve closing spring 104 until the upper end face 68 of the armature 56 contacts the lower end face 66 of the pole 54 as shown in FIG. 17. When the upper end face 68 of the armature 56 contacts the lower end face 66 of the pole 54, the coil spring 100 inside the armature 56 is compressed, gap 102 between the armature 56 and the upper armature stop 96*a* is closed, gap 103 is present between the armature 56 and the lower armature stop 96*b* as shown in FIG. 17. It will be apparent that gaps 102, 103 are approximately equal and when gap 102 is opening, gap 103 is closing and vice versa.

As shown in FIG. 2, upper armature stop 96*a* includes a radially projecting flange 95 that is captured between the lower end face 66 of the pole and an annular shoulder 57 of the armature 56. As shown in FIG. 12, the axial thickness 55 of the flange 95 on the upper armature stop 96*a* may be less than the axial distance 53 between the shoulder 57 and upper end face 68 of the armature 56, allowing the valve needle 40 (with upper armature stop 96*a*, lower armature stop 96*b* and valve member 38) to keep moving in the opening direction until gap 103 between the armature 56 and the lower armature stop 96*b* has closed. In one embodiment, the difference between axial thickness 55 and axial distance 53 is greater than gap 103, so the upper face of flange 95 never impacts the lower end face 66 of the pole 54. The armature 56 is stopped suddenly by contact with the lower end face 66 of the pole 54, but this sudden change is not reflected directly to the valve needle 40 due to the relative movement allowed between the valve needle 40 and the armature 56 between stops 96*a* and 96*b*. Decoupling the mass of the armature 56 from the valve needle 40 limits transmission of energy from sudden changes in direction/momentum of the armature 56 to the valve needle 40 and valve member 38, which minimizes unintended fueling at the beginning and end of injection. Stated alternatively, the disclosed connection between the armature 56 and the valve needle 40 promotes settling of the valve needle and valve member after opening or closing to increase linear portion of an injection event by allowing each of the armature 56 and valve needle 40 limited movement relative to each other. In the disclosed fuel injector 10, the impact of the armature 56 and valve needle 40 are separated from each other in both the opening and closing directions of the valve.

The valve member 38 may be a spherical ball welded to the end of the valve needle 40 opposite the armature 56. When the coil 70 is not energized, a valve closing spring 104 bears on the upper armature stop 96*a* to bias the valve needle 40 and valve member 38 toward the valve seat 34 and a closed position. In the closed position, the outside surface of the valve member 38 is in contact with the valve seal 36, preventing fuel flow through the fuel injector 10. The gap 102 between the armature shoulder 57 and the flange 95 of the upper armature stop 96*a* shown in FIG. 12 is present when the valve needle 40 and valve member 38 are in the closed position because the distance between the facing surfaces of the armature stops 96*a*, 96*b* is slightly greater than the axial length of the armature 56 between its lower surface and the shoulder 57. The difference between the armature stops 96*a*, 96*b* and the axial length of the armature 56 is the axial dimension of gaps 102, 103. Force from the valve closing spring 104 is applied to the top of the flange 95 of the upper armature stop 96*a* and holds the valve member 38 against the valve seal 36, but the armature 56 is biased away from the flange 95 of the upper armature stop 96*a* by armature spring 100 to open gap 102. When not attracted to the pole 54, the armature 56 can return to a position biased toward the lower armature stop 96*b* and spaced apart from the upper armature stop 96*a*. According to aspects of the disclosure the spring rate and force of return spring 104 are greater than the spring rate and force of the armature spring 100.

FIGS. 8-11 illustrate a valve seat 34 according to aspects of the disclosure. The valve seat 34 includes a plurality of guide surfaces 106 arranged around the valve member 38 to guide axial movement of the valve member 38. Beneath the valve member 38, the valve seat 34 includes a valve seal 36 surrounding a fuel sac 44. The fuel sac 44 communicates with a plurality of fuel injection orifices 42, the number and configuration of which can be altered to provide desired fuel flow characteristics during an injection event. The disclosed valve seat 34 defines five fuel injection orifices 42 arranged about the longitudinal axis A-A of the injector 10, but this is only one example of a possible arrangement of injection orifices. The valve seal 36 is an annular conical surface that is contacted by the valve member 38 when the fuel injector 10 is closed. The spherical outside surface of the valve member 38 will contact the conical valve seal 36 along an annular line of contact where the conical valve seal 36 is tangent to the outside surface of the valve member 38. As shown in FIG. 10, the annular valve seal 36 has a limited radial extent defined by a back cut 108. The back cut 108 allows fuel flow between the valve member 38 and the valve seal 36 to reach peak flow more quickly than if the surface of the valve seal 36 extended radially outward a large distance beyond the annular contact between the outside surface of the valve member 38 and the valve seal 36. The back cut 108 also minimizes pressure drop to the seal 36. FIG. 10 illustrates the valve member in the open position, separated from the valve seal 36.

With reference to FIGS. 1 and 2, the pole 54 is press fit into the upper valve body 58 after the armature/needle assembly is inserted into the lower valve body 60. The position of the lower end face 66 pole 54 relative to the upper end face 68 of the armature 56 in the closed position defines the lift or stroke of the valve needle 40 and valve member 38 by setting the axial dimension of gap 64 between the upper end face 68 of the armature and the lower end face 66 of the pole 66. The pole 54 is pressed into the upper valve body 58 until the gap 64 reaches a pre-determined axial distance. The stroke of the valve needle is equal to the axial gap 64 between the pole 54 and the armature 56 minus the axial gap 102 between the armature 56 and the upper armature stop 96*a*. When the valve stroke has been calibrated by pressing the pole 54 into position, the valve closing spring 104 is inserted into the center of the pole 54 to rest on top of the upper armature stop 96*a*. A metal filter tube 110 is then inserted into the central opening of the pole 54 and press fit to load the valve closing spring 104 to a desired closing force. The force required to move the pole 54 relative to the upper valve body 58 is very high, so that when the valve stroke has been set, the pole 54 remains in the calibrated position. The force required to move the filter tube 110 relative to the pole 54 is relatively low, so that adjustment of the preload on the valve closing spring 104 cannot disturb the position of the pole 54. The upper end of the filter tube 110 is crimped over a filter 112 and a noise orifice plate 114. The filter 112 prevents particulates from passing into the injector 10 and possibly clogging the fuel injection orifices 42 or lodging between the valve member 38 and the valve seal 36. The orifice plate 114 defines a central orifice 116 that allows fuel flow toward the valve seat 34 but reduces reflection of hydraulic pressure waves caused by opening and closing of the valve member 38 upstream into the fuel system. The filter 112 and orifice plate 114 may be inexpensively manufactured from plastic such as nylon and are surrounded and protected by the metal filter tube 110 during assembly. According to aspects of the disclosure, the inlet 20 is inserted and welded to the valve body 30 after the valve stroke and closing force have been calibrated as described above.

What is claimed:

1. A fuel injector for injecting fuel in a combustion engine, the fuel injector comprising:

a valve with a needle connected to a valve member and moveable along a longitudinal axis between an open and a closed position, to open and close the valve;

an actuator comprising an armature and a pole wherein the armature is axially moveable and coupled to the valve needle to move the valve needle toward the open position when the armature moves toward the pole, the armature having a first position axially spaced from the pole to define a first axial gap when the valve needle is the closed position and a second position in contact with the pole when the valve needle is in the open position, the armature coupled to the valve needle by a first armature stop between the armature and the valve member and a second armature stop between the armature and the pole, said first and second armature stops secured in fixed positions to the valve needle, the armature axially moveable relative to the valve needle between said first and second armature stops and biased toward said first armature stop by an armature spring between the armature and the second armature stop to define a second axial gap between the armature and the second armature stop when the valve is in the closed position, said armature defines an axial recess surrounding said valve needle and said armature spring is positioned in said axial recess and biased between a bottom of the axial recess and a lower surface of the second armature stop, said armature defines at least one fuel flow passage communicating between said axial recess and an area between the armature and the valve member, said axial recess includes an annular peripheral portion defined between an annular shoulder and an upper face of the armature, said second armature stop including a radially projecting flange extending radially beyond said annular shoulder and captured axially between the shoulder and the pole, said radially projecting flange including at least one opening allowing fluid communication from an area between the second armature stop and the pole and the axial recess;

a valve closing spring in contact with an upper surface of said second armature stop for biasing the valve needle away from the pole and toward the closed position;

wherein the at least one opening, axial recess and at least one fuel flow passage permit fluid communication from the area between the second armature stop and the pole to the area between the armature stop and the valve member, a bias of the valve closing spring is greater than a bias of the armature spring and movement of the armature toward the pole compresses the armature spring to close the second axial gap before the armature contacts the second armature stop to compress the return spring to move the valve needle toward the open position.

2. The fuel injector of claim 1, wherein the armature has an axial length from an armature upper end face adjacent a lower end face of the pole and an armature lower end face adjacent the first armature stop, said needle and valve member moving in the opening direction after the armature upper end face contacts the lower end face of the pole, movement of said valve needle and valve member in the opening direction stopped by contact between the armature lower end face and the first armature stop.

3. The fuel injector of claim 1, wherein said first axial gap is at least twice as large as said second axial gap.

4. The fuel injector of claim 1, wherein closure of said second axial gap opens a third axial gap between the armature and the first armature stop, said third axial gap permitting the valve needle to continue moving in the opening direction after the armature contacts the pole until the armature contacts the lower armature stop.

5. The fuel injector of claim 4, wherein movement of the valve needle and valve member in the opening direction after contact between the armature and the pole is resisted by the valve closing spring.

6. The fuel injector of claim 4, wherein the peripheral portion of the axial recess has an axial depth between the shoulder and an upper end face of the armature and the flange has an axial thickness less than said axial depth, whereby movement of the valve needle and valve member are stopped without contact between the flange and a lower end face of the pole.

7. The fuel injector of claim 1, wherein said at least one opening comprises at least one notch extending radially inward from a periphery of the radially projecting flange beyond a diameter of said annular shoulder.

8. The fuel injector of claim 1, wherein movement of the valve needle and valve member in the opening direction is resisted only by a bias of the valve closing spring.

9. The fuel injector of claim 1, wherein axial movement of the armature between the first and second armature stops decouples a mass of the armature from a mass of the valve needle, so that impacts and momentum changes of the armature are not directly transferred from the armature to the valve needle.

10. The fuel injector of claim 1, wherein said armature is a single unitary part.

11. A fuel injector for injecting fuel into a combustion engine, the fuel injector comprising:

a valve body surrounding a valve with a valve needle moveable along a longitudinal axis between an open position and a closed position, said valve body including a magnetic upper portion, a non-magnetic intermediate portion and a magnetic lower portion, said upper portion, intermediate portion and lower portion integrally connected to define an uninterrupted cylindrical side wall of said valve body;

an armature coupled to the valve needle to move the valve needle toward the open position when the armature moves toward a pole, the armature, valve needle and pole arranged within said valve body with said valve needle biased toward the closed position by a valve closure spring to define an axial gap between the armature and the pole;

a coil surrounding the valve body and generating magnetic force through the pole and armature to attract the armature toward the pole, compress the valve closure spring and close the axial gap when the coil is energized, wherein said non-magnetic intermediate portion of the valve body surrounds the axial gap and the coil surrounds the non-magnetic intermediate portion.

12. The fuel injector of claim 11, wherein the magnetic portions of the valve body are magnetic steel and the non-magnetic intermediate portion of the valve body is non-magnetic steel.

13. A fuel injector for injecting fuel into a combustion engine, the fuel injector comprising:

a valve body surrounding a valve with a valve needle moveable along a longitudinal axis between an open position and a closed position;

an armature coupled to the valve needle to move the valve needle toward the open position when the armature moves toward a pole, the armature, valve needle and pole arranged within said valve body with said valve needle biased toward the closed position by a valve closure spring;

a modular power group comprising a coil assembly including an annular coil with conductors extending from the annular coil to an electrical connector, the annular coil embedded in plastic that surrounds the conductors and at least partially forms the electrical connector, a first flux washer surrounding the valve body at one axial end of the coil, a cylindrical housing in contact with the first flux washer and outwardly surrounding the coil, and a second flux washer in contact with the cylindrical housing and extending around a majority of a circumference of the valve body at a second axial end of the coil, wherein the first flux washer, cylindrical housing, and second flux washer are individual parts separate from the coil assembly before being secured to said valve body, said first flux washer, cylindrical housing and second flux washer forming part of a magnetic circuit extending through the armature and pole, said coil generating a magnetic field in the magnetic circuit when energized, said magnetic field attracting the armature to the pole to move the valve needle toward the open position against the bias of the valve closure spring.

14. The fuel injector of claim 13, wherein said valve body is connected to an inlet to form a sealed fuel tube and the inlet includes features mating with the coil assembly to retain the coil assembly to the fuel injector.

15. The fuel injector of claim 13, wherein the first flux washer, cylindrical housing and second flux washer are welded to each other after assembly to the valve body.

16. The fuel injector of claim 13, wherein the second flux washer is interrupted by a slot and the conductors extend axially through the slot to the electrical connector.

* * * * *